United States Patent [19]

Looger, deceased et al.

[11] Patent Number: 4,895,076

[45] Date of Patent: Jan. 23, 1990

[54] SUB-CALIBER TRAINER ROUND

[75] Inventors: Lonnie L. Looger, deceased, late of Madison, Ala., by Joyce H. Looger, executor; John W. Byrd, Owens Cross Roads, Ala.

[73] Assignee: The United States of America as represented by the Secretary of the Army, Washington, D.C.

[21] Appl. No.: 325,613

[22] Filed: Mar. 8, 1989

[51] Int. Cl.[4] ..... F42B 11/00; F42B 11/18

[52] U.S. Cl. ..... 102/439; 102/444; 102/513; 102/517; 102/529

[58] Field of Search ..... 102/439, 444–447, 102/448, 455, 498, 513, 529, 517, 395

[56] References Cited

U.S. PATENT DOCUMENTS

| | | | |
|---|---|---|---|
| 1,920,257 | 8/1933 | Halland | 102/395 |
| 2,414,863 | 1/1947 | Foster | 102/517 |
| 3,880,083 | 4/1975 | Wasserman et al. | 102/529 |
| 4,043,267 | 8/1977 | Hayashi | 102/439 |
| 4,471,699 | 9/1984 | Turco et al. | 102/517 |
| 4,538,520 | 9/1985 | Schmitz | 102/439 |

*Primary Examiner*—Harold J. Tudor

*Attorney, Agent, or Firm*—Freddie M. Bush; James T. Deaton

[57] ABSTRACT

A sub-caliber trainer round that includes a projectile with weighted means for weighting the projectile to the desired weight and the projectile having a rear piston like portion for sliding in a cylindrical bore and having a front portion as a marking means for marking the impact position of the projectile relative to a target. The projectile is designed to be mounted in a cylindrical bore as a shotgun shell with a primer and powder for launching the projectile in much the same manner as a shotgun shell.

5 Claims, 1 Drawing Sheet

SUB-CALIBER TRAINER ROUND

DEDICATORY CLAUSE

The invention described herein may be manufactured, used, and licensed by or for the Government for governmental purposes without the payment to us of any royalties thereon.

BACKGROUND OF THE INVENTION

In the use of shoulder-fired rockets there is a need for an inexpensive sub-caliber trainer round that can be used by troops that are being trained to use the shoulder-fired rockets. These trainer rounds need to be capable of being miniature in size relative to the actual rockets that are launched at targets and these small trainer rounds need to have the capability of being ballistically matched with the ballistics of an actual tactical round.

Accordingly, it is an object of this invention to provide a miniature trainer round.

Another object of this invention is to provide a trainer round that can be ballistically matched to that of a tactical round.

Still another object of this invention is to provide a trainer round that can be produced cheaply.

Still another object of this invention is to provide a trainer round that has means for visually indicating the impact point of the trainer round relative to a target.

Other objects and advantages of this invention will be obvious to those skilled in this art.

SUMMARY OF THE INVENTION

In accordance with this invention, a sub-caliber trainer round is provided that includes an elongated cylindrical housing with a primer charge at one end and a weighted unitary projectile slidably mounted in a tubular portion of said housing with powder mounted between the projectile and the primer for producing propelling means for propelling said projectile out of said housing. The projectile also has a marking means at a front end thereof for marking the position of impact of the projectile with a target.

DETAILED DESCRIPTION OF THE DRAWING

Figure 1:
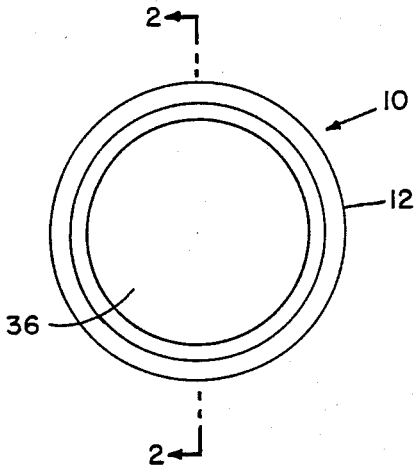
Figure 2:
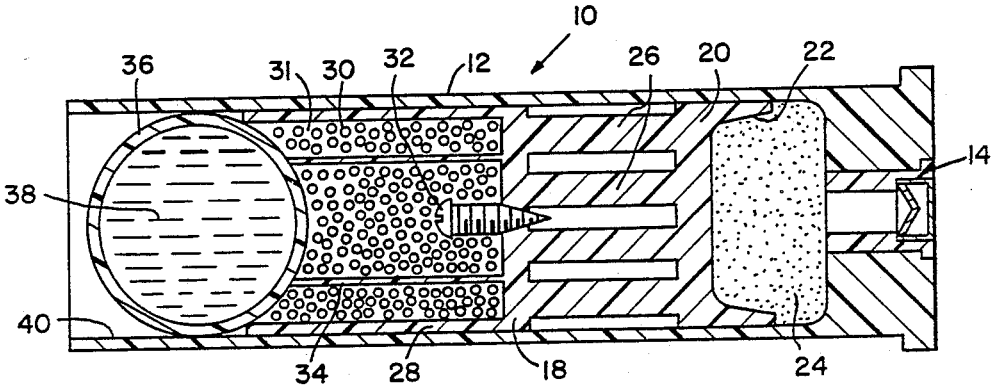
Figure 3:
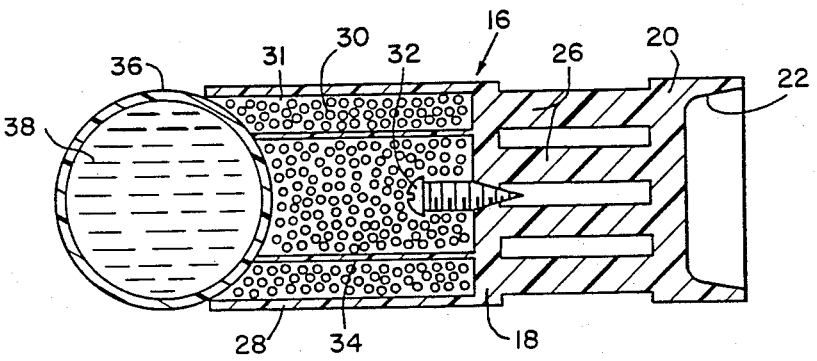

FIG. 1 is an end view of a sub-caliber trainer round in accordance with this invention, FIG. 2 is a sectional view along line 2—2 of FIG. 1; and FIG. 3 is a sectional view of a projectile.

DESCRIPTION OF THE PREFERRED EMBODIMENT

Referring now to the drawings, training round 10 in accordance with this invention includes a cylindrical shell housing 12 that is open at one end and has a primer charge 14 mounted at the other end as illustrated. Primer 14 can be that such as used in a conventional shotgun shell. Casing 12 can be made of plastic materials or other similar materials that are used in the art for this purpose.

A projectile 16 is made with a housing structure 18 that is made of an appropriate support material that can be a plastic material such as polyethylene. Structure 18 includes a rear cup-like piston portion 20 that has a cup-shape 22 with piston portion 20 forming with the closed end of shell 12 a chamber which has black powder 24 therein. Strip sections 26 innerconnect an intermediate portion as illustrated and a front section 28 defines a chamber or chambers for having the appropriate weight for the projectile mounted therein. This appropriate weight can be pellets 30 of lead or other appropriate material that are bonded together with an appropriate bonding material 31, and a securing means 32 is mounted as illustrated so that the bonding material will securely bond the pellets in place inside the chamber of front section 28. Front section 28 also has a cylindrical portion 34 for supporting ball 36. Ball 36 or other convenient type container has a marking substance 38 therein such as paint. Ball 36 is bonded in place relative to the end cylindrical structure 34 and relative to section 28 to secure the projectile together as one unit. The weight of projectile 16 is such that the center of gravity of the projectile is in front of the center of pressure of projectile 16. Projectile 16 is slidably mounted into the inner surface 40 of housing 12 to form a sub-caliber trainer round that can be mounted in a barrel for shooting a projectile of this type.

In operation, with projectile 16 mounted in housing 12 with the appropriate amount of black powder 24 mounted in the shell as illustrated and with the proper weight for projectile 16, the tragectory and velocity of projectile 16 can be matched to that of an actual round that would normally be launched from a rocket launcher such as a shoulder fired rocket launcher weapon. Shell 10 is designed to be fired from a conventional gun barrel that is mounted inside a conventional shoulder fired rocket launcher to enable shell 10 to act as a trainer round that is ballistically matched to have the same initial velocity and trajectory of an actual tactical round that would normally be launched from the shoulder fired launcher. When it is desired to fire shell 10, the plunger of the gun would be caused to strike primer round 14 to cause black powder 24 to be exploded and expell projectile 16 from cylindrical section 12. Projectile 16 will then be propelled at a particularly desired velocity and at the desired tragectory toward a target and will serve as a training round for a soldier that is training to use a shoulder fired weapon. Ball 36 with appropriate marking means such as paint therein will burst and mark the impact point of projectile 16 with a desired target. The noise and recoil associated with firing a trainer round contained inside a rocket launcher completes the training scenario. The trainee has then experienced the firing of a trainer round which is equivalent to experiencing that of an actual tactical missile. However, by using the trainer round rather than an actual tactical missile, the cost and danger to the trainee is greatly reduced. It will be appreciated that a typical round as a trainee round can reasonably be produced for about one to two dollars.

The ballisticially matched training round or projectile 16 can also be launched from a barrel using compressed air. This further reduces the training cost if a large number of firings are necessary. In this arrangement, an air gun would replace the barrel of the sub-caliber that would be mounted in the launcher tube of the shoulder fired rocket launcher.

If desired, projectile 16 could have a tracer pellet incorporated into the projectile for additional realism. The tracer pellet would give a continuous visual track to the target and paint-filled ball 36 at the front portion of the projectile would give a record on the target itself for scoring and evaluation.

What is claimed:

1. A projectile comprising a body section that is generally cylindrical and has a rear section and a forward section that are innerconnected by rib means, said forward section having a forwardly opening cavity therein and securing means at the base of said cavity, said cavity having pelletized weighted means bonded therein and to said securing means, and marker means secured at the forward end of said cavity, said projectile being constructed for weight distribution such that the projectile has a center of gravity that is in front of a center of pressure of the projectile.

2. A projectile as set forth in claim 1, wherein said pelletized weighted means includes metal pellets that are bonded together with an epoxy to secure the pellets in said cavity relative to said securing means.

3. A projectile as set forth in claim 2, wherein said marking means is a spherical ball member that contains a paint marking substance therein.

4. A projectile as set forth in claim 3, wherein said rear section of said body is cup-shaped to form a piston.

5. A trainer round comprising a projectile having a body section that is generally cylindrical and has a rear section and a forward section that are innerconnected by rib means, said forward section having a forwardly opening cavity therein and securing means at the base of said cavity, said cavity having weighted means bonded therein and to said securing means, marker means secured at the forward end of said cavity, said projectile being constructed for weight distribution such that the projectile has a center of gravity that is in front of a center of pressure of the projectile, said weighted means including metal pellets that are bonded together with an epoxy to secure the pellets in said cavity relative to said securing means, said marking means being a spherical ball member that contains a paint marking substance therein, said rear section of said body being cup-shaped to form a piston, said projectile being mounted in a shell type housing that includes a cylindrical device that is open at one end and closed at the other end to define a chamber between the closed end of said shell and said piston, said chamber between said closed end and said piston having powder therein, and said closed end of said shell having a primer charge for igniting said powder when struck by appropriate means for setting off said primer charge.

* * * * *